United States Patent [19]

Boulton

[11] Patent Number: 4,464,242

[45] Date of Patent: Aug. 7, 1984

[54] ELECTRODE STRUCTURE FOR USE IN ELECTROLYTIC CELL

[75] Inventor: Thomas W. Boulton, Cheshire, England

[73] Assignee: Imperial Chemical Industries PLC, Hertfordshire, England

[21] Appl. No.: 440,855

[22] Filed: Nov. 12, 1982

[30] Foreign Application Priority Data

Nov. 24, 1981 [GB] United Kingdom ..... 8135410

[51] Int. Cl.[3] ..... C25B 11/03

[52] U.S. Cl. ..... 204/253; 204/284; 204/288; 204/289; 204/292

[58] Field of Search ..... 204/282, 283, 284, 288, 204/292, 293, 242, 289, 253

[56] References Cited

U.S. PATENT DOCUMENTS

| | | | |
|---|---|---|---|
| 1,153,168 | 9/1915 | Levin | 204/292 |
| 1,788,904 | 1/1931 | Zdanski | 204/284 |
| 4,236,989 | 12/1980 | Dahlberg | 204/283 |

FOREIGN PATENT DOCUMENTS

| | | | |
|---|---|---|---|
| 0555387 | 7/1923 | France | 204/288 |
| 56-0038486 | 4/1981 | Japan | 204/282 |
| 1433693 | 6/1974 | United Kingdom . | |
| 2032458 | 7/1979 | United Kingdom . | |
| 0783364 | 12/1980 | U.S.S.R. | 204/283 |

*Primary Examiner*—R. L. Andrews
*Assistant Examiner*—Terryence Chapman
*Attorney, Agent, or Firm*—Cushman, Darby & Cushman

[57] ABSTRACT

An electrode structure comprising an electrically conductive sheet material, a plurality of projections on at least one surface of the sheet material and preferably on both surfaces, which are spaced apart from each other in a first direction and in a direction transverse thereto, and a flexible electrically conductive foraminous sheet or sheets electrically conductively bonded to the projections.

13 Claims, 4 Drawing Figures

ELECTRODE STRUCTURE FOR USE IN ELECTROLYTIC CELL

Figure 1:
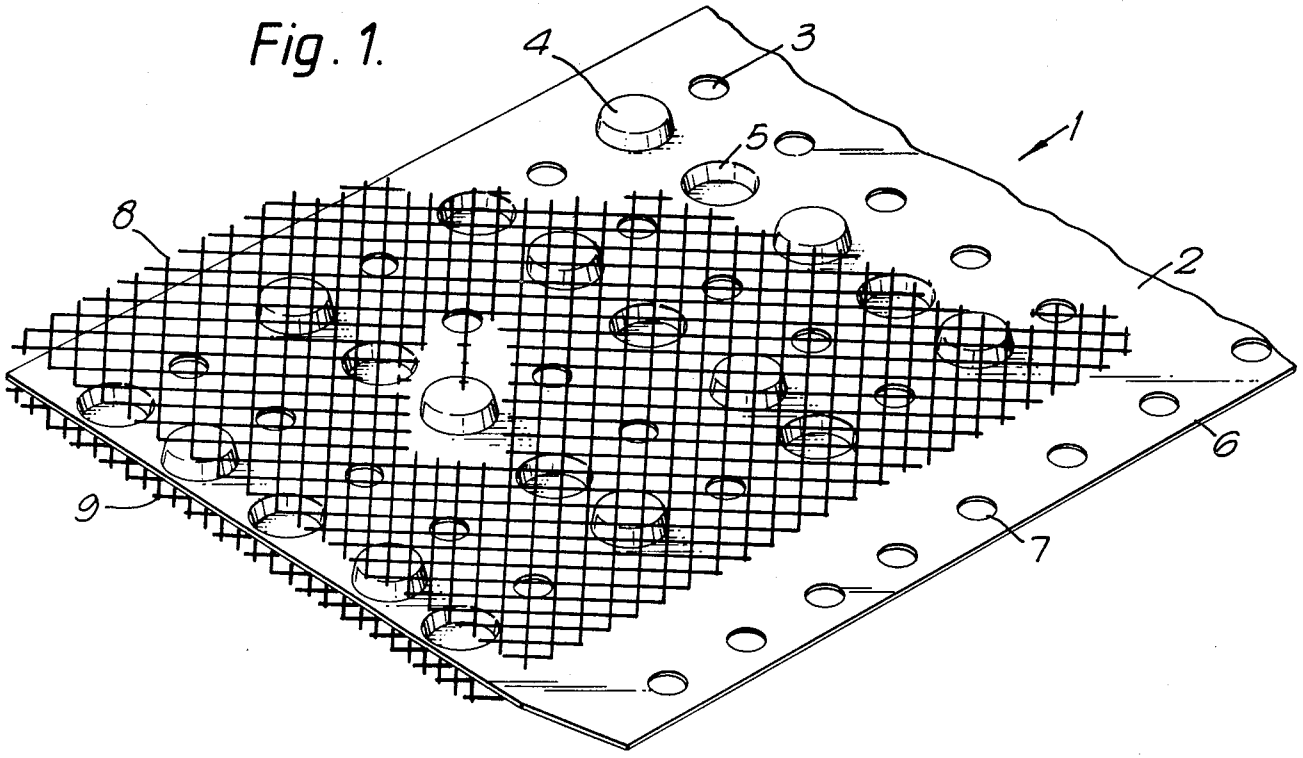

This invention relates to an electrode structure for use in an electrolytic cell, in particular to an electrode structure for use in an electrolytic cell of the filter press type, and to an electrolytic cell containing the electrode structure.

Electrolytic cells are known comprising a plurality of alternating anodes and cathodes of foraminate structure arranged in separate anode and cathode compartments. The cells also comprise a separator, which may be a hydraulically permeable porous diaphragm or a substantially hydraulically impermeable ion-exchange membrane, positioned between adjacent anodes and cathodes thereby separating the anode compartments from the cathode compartments, and the cells are also equipped with means for feeding electrolyte to the anode compartments and if necessary liquid to the cathode compartments, and with means for removing the products of electrolysis from these compartments.

In such electrolyte cells the electrode structures may be formed by a pair of spaced foraminate sheet materials.

The electrolytic cell may be used, for example in the electrolysis of alkali metal chloride solution, e.g. aqueous sodium chloride solution. In the case of a cell equipped with a porous diaphragm aqueous alkali metal chloride solution is charged to the anode compartments of the cell, and chlorine is discharged from the anode compartments and hydrogen and cell liquor containing alkali metal hydroxide are discharged from the cathode compartments of the cell. In the case of a cell equipped with an ion-exchange membrane aqueous alkali metal chloride solution is charged to the anode compartments of the cell and water or dilute aqueous alkali metal hydroxide solution to the cathode compartments of the cell, and chlorine and depleted aqueous alkali metal chloride solution are discharged from the anode compartments of the cell and hydrogen and alkali metal hydroxide are discharged from the cathode compartments of the cell.

It is desirable to operate such electrolytic cells at as low a voltage as possible in order to consume as little electrical power as possible. The voltage is determined in part by the interelectrode gap, that is the gap between the anode and adjacent cathode, and in recent designs of electrolytic cell it has been proposed to arrange for a low anode-cathode gap, even a zero anode-cathode gap, in which the anode and cathode are in contact with the separator positioned between the anode and cathode.

However, electrolytic cells in which the anode-cathode gap is zero do suffer from problems in that contacting the separator with the anode and cathode may lead to pressure being exerted on the separator and may possibly result in deviations from uniformity in the separator or even to rupture of the separator.

This is particularly the case where the separator is an ion-exchange membrane where it is desirable to apply an even pressure to the membrane through the foraminate anode and cathode.

Solutions to the aforementioned problems have been proposed. An electrode structure has been proposed which comprises a central vertically disposed plate, spaced vertically disposed ribs positioned on either side of the plate, and foraminate screens attached to the ribs. When such an electrode structure is assembled into an electrolytic cell the ribs of the anode are offset from the ribs of the adjacent cathode so that the separator positioned between the electrodes is not trapped between adjacent ribs and assumes a slight sinusoidal shape. In another proposed electrode structure the plate and ribs are replaced by a metal sheet folded to provide vertically disposed vertexes and foraminate screens are positioned on either side of the sheet and attached to the vertexes. When such an electrode structure is assembled into an electrolytic cell the vertexes of the anode are offset from the vertexes of the adjacent cathode so that the separator positioned between the electrodes is not trapped between adjacent vertexes and assumes a slight sinusoidal shape.

Electrode structures of the aforementioned types are described in published GB patent application No. 2032458A. In this patent application the electrode structures are used as current distributing devices and the separator is a solid polymer electrolyte, that is an ion-exchange membrane in which the electrodes are attached to, for example embedded in, the surfaces of the membrane.

When such electrode structures, or current distributing devices, are installed in an electrolytic cell the vertically disposed ribs and vertexes, although permitting vertical flow of liquors in the anode and cathode compartments of the cell, do not permit horizontal flow of liquors with the result that the mixing of the liquors in the separate anode and cathode compartments may not be as good as may be desired. Indeed, the liquors in the compartments of the cell may show concentration gradients caused by the inadequate mixing.

The present invention relates to an electrode structure which allows an evenly distributed pressure to be exerted on a separator positioned between and in contact with adjacent structures, which is of simple construction and which is easy to fabricate, and which permits both horizontal and vertical flow of the liquors in the electrode compartments of the cell thus permitting good mixing of the liquors in the electrode compartments of the cell.

According to the present invention there is provided an electrode structure comprising an electrically conductive sheet material and at least one flexible electrically conductive foraminate sheet spaced apart from the sheet material and electrically conductively bonded thereto, characterised in that a plurality of projections are positioned on at least one surface of the sheet material which projections are spaced apart from each other in a first direction and in a direction transverse to the first direction, and in that the flexible electrically conductive foraminate sheet(s) are electrically conductively bonded to the projections.

An electrode structure in which a foraminate sheet is bonded to projections on one surface of the sheet material may be used as a terminal electrode in an electrolytic cell. Where the electrode structure is to serve as an internal electrode in an electrolytic cell the electrode structure preferably comprises projections on both surfaces of the sheet material with foraminate sheets electrically conductively bonded to the projections on both surfaces.

It will be appreciated that as the projections on the sheet material are spaced apart from each other in a first direction and in a direction transverse to the first direction flow of liquor in both a horizontal and a vertical direction in the space between the sheet material and the foraminate sheet will be permitted. In order to permit flow of liquor in a direction transverse to the plane of the foraminate sheets and transverse to the plane of the sheet material it is also preferred, in the electrode structure comprising two such foraminate sheets, that the sheet material has openings therein.

The sheet material may be metallic. The material of construction of the sheet material will depend on whether the electrode structure is to be used as an anode or a cathode and on the nature of the electrolyte which is to be electrolysed. For example, where the electrode structure is to be used as an anode, particularly in an electrolytic cell in which aqueous alkali metal chloride solution is to be electrolysed, it may suitably be formed of a so-called valve metal, e.g. titanium, zirconium, niobium, tantalum or tungsten, or an alloy consisting principally of one or more of these metals. Where the electrode structure is to be used as a cathode the sheet material may be, for example, steel, e.g. stainless steel or mild steel, nickel, copper, or nickel-coated or copper coated steel.

The sheet material of the electrode structure is desirably of a thickness such that the sheet material is itself flexible and preferably resilient.

The projections on the surface of the sheet material will be electrically conducting and may be metallic and may be formed in a variety of ways. For example, the projections on a surface of the sheet material may have a conical or frusto-conical shape and they may be formed by application of a suitably shaped tool to the opposite surface of the sheet material. Where the projections are of conical or frusto-conical shape and are formed in this way on both surfaces of the sheet material the projections on one surface of the sheet material will necessarily be staggered in position with respect to the projections on the other surface of the sheet material. In a further method the projections may be formed by forming pairs of slits in the sheet material and pressing that part of the sheet material between the slits away from the plane of the sheet material. In this case also the projections on one surface of the sheet material will be staggered in position with respect to those on the other surface of the sheet material.

The projections are preferably symmetrically spaced apart. For example, they may be spaced apart by an equal distance in a first direction, and spaced apart by an equal distance, which may be the same, in a direction transverse, for example substantially at right angles, to the first direction.

However, the spacing apart of the projections in a first direction, that is the pitch of the projections may differ from the pitch of the projections in a direction transverse to the first direction. Thus, where the electrical conductivity of the foraminate sheet bonded to the projections is greater in a first direction than in a direction transverse thereto, as may be the case with an expanded metal foraminate sheet, then it is desirable to arrange for the pitch of the projections in a first direction to be greater than the pitch in a direction transverse thereto, in order to minimize the voltage drop and in order to provide an even distribution of electrical current across the foraminate sheet of the electrode.

The height of the projections from the plane of the sheet material governs the distance between the sheet material and the foraminate sheet, and in a structure containing two such sheets the distance between the foraminate sheets, and thus the depth of the electrode compartment in an electrolytic cell containing the electrode structure.

The height of the projections from the plane of the sheet material may for example be in the range 2 to 15 mm. The distance between adjacent projections on a surface of the sheet material may for example be in the range 1 to 50 cm, e.g. 2 to 25 cm.

It is preferred, in order that a separator may not be trapped between projections on adjacent electrodes, that the projections on one surface of the sheet material are staggered in position with respect to those on the opposite surface of the sheet material.

The foraminate sheet is desirably a metal or alloy and it will in general be of the same material as that of the sheet material. Thus, where the electrode structure is to be used as an anode the foraminate sheet may be made of a valve metal or an alloy consisting principally of a valve metal. Where the electrode structure is to be used as a cathode the foraminate sheet may be, for example, stainless steel, mild steel, nickel, copper, or nickel-coated or copper-coated steel.

The foraminate sheet may have any suitable structure and the precise structure is not critical. Thus, the foraminate sheet may be of expanded metal, or woven wire, or it may be a perforated sheet. The foraminate sheet may be electrically conductively bonded to the projections on the sheet material by any suitable means, for example by welding, by brasing or by use of an electrically conductive cement.

In order that pressure applied to a separator positioned between adjacent electrode structures may be evenly applied the foraminate sheet must be flexible, and it is particularly desirable that it has a flexibility greater than that of the sheet material of the electrode structure. Thus, the dimensions, and particularly the thickness, of the foraminate sheet should be chosen to achieve the desired flexibility. Although the desired flexibility will depend in part on the material of construction of the foraminate sheet the thickness will generally be in the range 0.1 to 1 mm. It is preferred that the foraminous sheet is resilient.

According to the present invention there is also provided an electrolytic cell comprising terminal electrodes, at least one electrode structure as hereinbefore described positioned between the terminal electrodes and comprising projections on both surfaces of an electrically conductive sheet material spaced apart from each other in a first direction and in a direction transverse to the first direction and flexible electrically conductive foraminate sheets electrically conductively bonded to the projections, and a separator positioned between the foraminate sheets of adjacent electrode structures, and between the electrode structures and the terminal electrodes, thereby dividing the cell into separate anode and cathode compartments.

The terminal electrodes, generally a terminal anode and cathode, may comprise an electrode structure of the invention in which a foraminate sheet is positioned on one surface only of a sheet material.

The electrolytic cell may comprise a plurality of electrode structures arranged alternately as anodes and cathodes between the terminal electrodes, each electrode structure comprising a foraminate sheet positioned on the projections on one surface of the sheet material and on the projections on the opposite surface of the sheet material.

The projections in an electrode structure, for example in an anode, are preferably so positioned that they are off-set with respect to the projections in the electrode structure, for example in the cathodes, adjacent thereto, so that a separator positioned between the foraminate sheets of adjacent electrode structures is not trapped between two adjacent projections thus avoiding deviations from uniformity in the separator or even rupture of the separator.

The electrode structures and at least the foraminate sheets thereof, may be coated with a suitable electro-conducting electrocatalytically active material. For example, where the electrode structure is to be used as an anode, e.g. in the electrolysis of aqueous alkali metal chloride solution, the anode may be coated with one or more platinum group metals, that is platinum, rhodium, iridium, ruthenium, osmium or palladium, and/or an oxide of one or more of these metals. The coating of platinum group metal and/or oxide may be present in admixture with one or more non-noble metal oxides, particularly one or more film-forming metal oxides, e.g. titanium dioxide. Electro-conducting electrocatalytically active materials for use as anode coatings in an electrolytic cell, particularly a cell for the electrolysis of aqueous alkali metal chloride solution, and methods of application of such coatings, are well known in the art.

Where the electrode structure is to be used as a cathode, e.g. in the electrolysis of aqueous alkali metal chloride solution, the cathode may be coated with a material designed to reduce the hydrogen over-potential at the cathode. Suitable coatings are known in the art.

The electrolytic cell in which the electrode of the invention is installed may be of the diaphragm or membrane type. In the diaphragm type cell the separators positioned between adjacent anodes and cathodes to form separate anode compartments and cathode compartments are microporous and in use the electrolyte passes through the diaphragms from the anode compartments to the cathode compartments. Thus, in the case where aqueous alkali metal chloride solution is electrolysed the cell liquor which is produced comprises an aqueous solution of alkali metal chloride and alkali metal hydroxide. In the membrane type electrolytic cell the separators are essentially hydraulically impermeable and in use ionic species are transported across the membranes between the compartments of the cell. Thus, where the membrane is a cation-exchange membrane cations are transported across the membrane, and in the case where aqueous alkali metal chloride solution is electrolysed the cell liquor comprises an aqueous solution of alkali metal hydroxide.

Where the separator to be used in the electrolytic cell is a microporous diaphragm the nature of the diaphragm will depend on the nature of the electrolyte which is to be electrolysed in the cell. The diaphragm should be resistant to degradation by the electrolyte and by the products of electrolysis and, where an aqueous solution of alkali metal chloride is to be electrolysed, the diaphragm is suitably made of a fluorine-containing polymeric material as such materials are generally resistant to degradation by the chlorine and alkali metal hydroxide produced in the electrolysis. Preferably, the microporous diaphragm is made of polytetrafluoroethylene, although other materials which may be used include, for example, tetrafluoroethylene - hexafluoropropylene copolymers, vinylidene fluoride polymers and copolymers, and fluorinated ethylene - propylene copolymers.

Suitable microporous diaphragms are those described, for example, in UK Pat. No. 1503915 in which there is described a microporous diaphragm of polytetrafluoroethylene having a microstructure of nodes interconnected by fibrils, and in UK Pat. No. 1081046 in which there is described a microporous diaphragm produced by extracting a particulate filler from a sheet of polytetrafluoroethylene. Other suitable microporous diaphragms are described in the art.

Where the separator to be used in the cell is a cation-exchange membrane the nature of the membrane will also depend on the nature of the electrolyte which is to be electrolysed in the cell. The membrane should be resistant to degradation by the electrolyte and by the products of electrolysis and, where an aqueous solution of alkali metal chloride is to be electrolysed, the membrane is suitably made of a fluorine-containing polymeric material containing cation-exchange groups, for example, sulphonic acid, carboxylic acid or phosphonic acid groups, or derivatives thereof, or a mixture of two or more such groups.

Suitable cation-exchange membranes are those described, for example, in UK Pat. Nos. 1184321, 1402920, 1406673, 1455070, 1497748, 1497749, 1518387 and 1531068.

The electrode structure of the present invention may be used as a current distributing device in an electrolytic cell equipped with an ion exchange membrane which is a so-called solid polymer electrolyte, and within the scope of the term electrode structure we include a current distributing device. The solid polymer electrolyte comprises an ion exchange membrane to one surface of which an electro-conducting electrocatalytically active anode material is bonded and to the other surface of which an electroconducting electrocatalytically active cathode material is bonded. Such solid polymer electrolytes are known in the art.

The anode current distributor which in the electrolytic cell engages the anode face of the solid polymer electrolyte should, in the case where aqueous alkali metal chloride is to be electrolysed, have a higher chlorine over voltage than the anode on the surface of the membrane in order to reduce the probability of chlorine evolution taking place at the surface of the anode current distributor. However, it is desirable that the surface of the anode current distributor, or at least those surfaces in contact with the anode on the membrane, have a non-passivatable coating thereon, particularly where the anode current distributor is made of a valve metal.

Where aqueous alkali metal chloride solution is to be electrolysed it is preferred, for similar reasons that the material of the cathode current distributor should have a hydrogen over-voltage higher than that of the cathode on the surface of the membrane.

The electrode structures may be provided with means for feeding electrical power to the structures. For example, this means may be provided by a projection which is suitably shaped for attachment to a busbar when the structure is assembled into an electrolytic cell.

The dimensions of the electrode structures in the direction of current flow, and in particular the dimensions of the foraminous sheet(s) of electrode structure in this direction, are preferably in the range 15 cm to 60 cm in order to provide short current paths which ensure low voltage drops in the electrode structures without the use of elaborate current carrying devices.

The electrode structure of the invention may be positioned in a gasket for ease of installation in an electrolytic cell. For example, the gasket may be in the form of a recessed frame the dimensions of the recess being such as to accept the sheet material of the electrode structure. The thickness of the gasket is conveniently substantially the same as the distance between the outwards facing surfaces of the foraminous sheet of the electrode structure. Alternatively, the dimensions of the sheet material, that is the length and breadth, may be somewhat larger than the corresponding dimensions of the foraminous sheets and the sheet material may be positioned between a pair of frame-like gaskets.

The gaskets should be made of an electrically insulating material. The electrically insulating material is desirably resistant to the liquors in the cell, and is suitably a fluorine-containing polymeric material, for example, polytetrafluoroethylene, polyvinylidene fluoride or fluorinated ethylene-propylene copolymer. Another suitable material is an EPDM rubber.

In the electrolytic cell in which the electrode structure of the invention is installed the individual anode compartments of the cell will be provided with means for feeding electrolyte to the compartments, suitably from a common header, and with means for removing products of electrolysis from the compartments. Similarly, the individual cathode compartments of the cell will be provided with means for removing products of electrolysis from the compartments, and optionally with means for feeding water or other fluid to the compartments, suitably from a common header.

For example, where the cell is to be used in the electrolysis of aqueous alkali metal chloride solution the anode compartments of the cell will be provided with means for feeding the aqueous alkali metal chloride solution to the anode compartments and if necessary with means for removing depleted aqueous alkali metal chloride solution from the anode compartments, and the cathode compartments of the cell will be provided with means for removing hydrogen and cell liquor containing alkali metal hydroxide from the cathode compartments, and optionally, and if necessary, with means for feeding water or dilute alkali metal hydroxide solution to the cathode compartments.

Although it is possible for the means for feeding electrolyte and for removing products of electrolysis to be provided by separate pipes leading to or from each of the respective anode and cathode compartments in the cell such an arrangement may be unnecessarily complicated and cumbersome, particularly in an electrolytic cell of the filter press type which may comprise a large number of such compartments. In a preferred type of electrolytic cell the gaskets have a plurality of opening therein which in the cell define separate compartments lengthwise of the cell and through which the electrolyte may be fed to the cell, e.g. to the anode compartments of the cell, and the products of electrolysis may be removed from the cell, e.g. from the anode and cathode compartments of the cell. The compartments lengthwise of the cell may communicate with the anode compartments and cathode compartments of the cell via channels in the gaskets e.g. in the walls of the gaskets.

Where the electrolytic cell comprises hydraulically permeable diaphragms there may be two or three openings which define two or three compartments lengthwise of the cell from which electrolyte may be fed to the anode compartments of the cell and through which the products of electrolysis may be removed from anode and cathode compartments of the cell.

Where the electrolytic cell comprises ion-exchange membranes there may be four openings which define four compartments lengthwise of the cell from which electrolyte and water or other fluid may be fed respectively to the anode and cathode compartments of the cell and through which the products of electrolysis may be removed from the anode and cathode compartments of the cell.

In an alternative embodiment the electrode structure, e.g. the sheet material may have openings therein which in the electrolytic cell form a part of compartments lengthwise of the cell.

It is necessary that in the electrolytic cell the compartments lengthwise of the cell which are in communication with the anode compartments of the cell should be insulated electrically from the compartments lengthwise of the cell which are in communication with the cathode compartments of the cell. Thus, in this alternative embodiment one or more of the openings in the electrode structure should have at least a lining of electrically insulating material in order to achieve the necessary electrical insulation between the compartments, or the necessary insulation may be achieved by having one or more of the openings in the electrode structure defined by a part of the structure which is itself made of an electrically insulating material.

The separators in the electrolytic cell may themselves have a plurality of openings therein which in the cell form a part of compartments lengthwise of the cell, or they may be associated with a gasket or gaskets which have the required plurality of openings therein.

The electrode structure of the present invention may be a bipolar electrode structure which comprises a first sheet material, preferably of metal, and a second sheet material, also preferably of metal, electrically conductively connected thereto, the sheet materials having a plurality of projections on the surfaces thereof which projections are spaced apart from each other in a first direction and in a direction transverse to the first direction, each face of the sheet materials having a flexible electrically conductive foraminate sheet electrically conductively bonded to the projections. For example, where the bipolar electrode structure is to be used in an electrolytic cell for the electrolysis of aqueous alkali metal chloride solution the first sheet material, and the foraminate sheet thereon, may function as an anode and may be made of a valve metal or an alloy thereof, and the second sheet material, and the foraminate sheet thereon, may function as a cathode and may be made of steel, nickel or copper or of nickel or copper coated steel.

The invention has been decribed with reference to an electrode structure suitable for use in an electrolytic cell for the electrolysis of aqueous alkali metal halide solution. It is to be understood, however, that the electrode structure may be used in electrolytic cells in which other solutions may be electrolysed, or in other types of electrolytic cells, for example in fuel cells.

The invention will now be described by reference to the following drawings.

Figure 2:
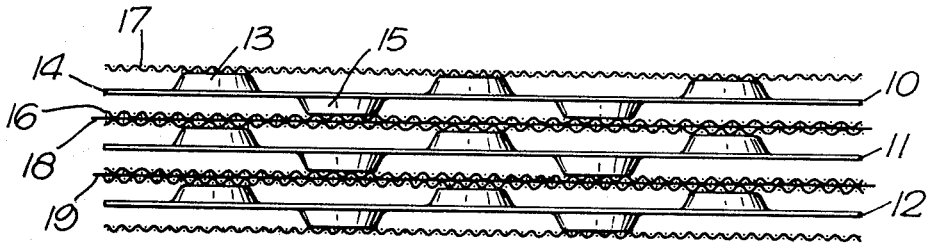
Figure 3:
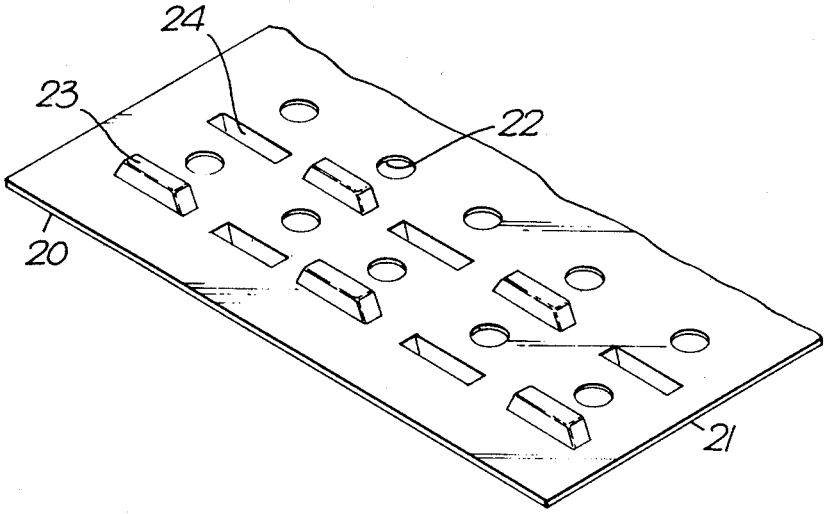
Figure 4:
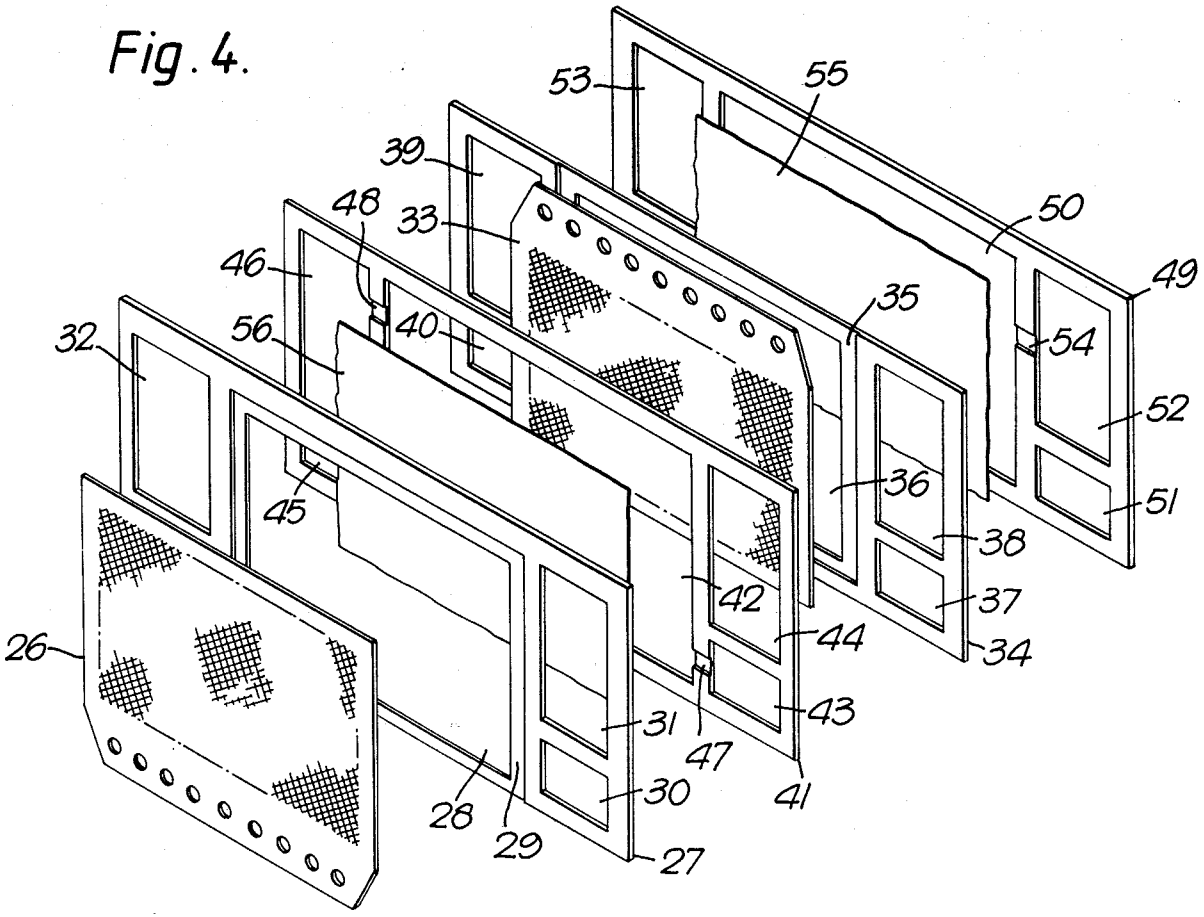

FIG. 1 shows an isometric view of part of an electrode structure of the invention partly cut away, FIG. 2 shows an end view of an assembly of three electrode structures of the invention as illustrated in FIG. 1, FIG. 3 shows an isometric view of a part of an alternative embodiment of an electrode structure of the invention, and FIG. 4 shows an exploded isometric view of a part of an electrolytic cell comprising electrode structure of the invention.

Referring to FIG. 1 the electrode structure (1) comprises a flexible metallic sheet (2) having a plurality of holes (3) therein which provide passages for flow of liquor from one side of the sheet to the other. On one face of the sheet (2) there are positioned a plurality of frusto-conical projections (4) spaced apart from each other in a first direction and in a direction transverse to the first direction. Similarly, on the opposite face of the sheet there are positioned a plurality of frusto-conical projections (5) spaced apart from each other in a first direction and in a direction transverse to the first direction. The frusto-conical projections (4,5) each 5 mm in height are formed by striking the sheet with a suitably shaped punch, and the projections (4) on one face are off set in position from the projections on the opposite face.

The metallic sheet (2) comprises an extension (6) having a plurality of holes therein through which connection may be made to a suitable source of electrical power. A flexible resilient metallic sheet in the form of a mesh (8) is positioned on the frusto-conical projections (4) on one face of the sheet (2) and electrically connected thereto by welding to the projections. The mesh sheet (8) has a flexibility greater than that of the sheet (2). Similarly, a flexible resilient metallic mesh sheet (9) is positioned on and welded to the frusto-conical projections (5) on the opposite face of the sheet (2).

The nature of the metal of the sheet (2) and of the mesh sheets (8,9) will depend on whether or not the electrode is to be used as an anode or a cathode and on the nature of the electrolyte which is to be electrolysed in the electrolytic cell in which the electrode is installed. Where the electrode is to be used as an anode in the electrolysis of an aqueous solution of an alkali metal chloride the electrode may suitably be made of a valve metal, e.g. titanium, and where the electrode is to be used as a cathode in such an electrolysis the electrode may suitably be made of mild steel, stainless steel, copper or nickel, or nickel-coated or copper-coated steel.

FIG. 2 shows an end view of an assembly of three electrodes structures (10,11,12) of the type shown in FIG. 1. Each electrode structure comprises a plurality of frusto-conical projections (13) on one face of a sheet (14), a plurality of similar projections (15) on the opposite face of the sheet (14), and flexible resilient mesh sheets (16,17) electrically conductively to the projections. Between each adjacent pair of electrodes there is positioned a cation-exchange membrane sheet (18,19) which is in contact with the mesh sheets on the adjacent facing electrodes. When pressure is applied to the cation-exchange membranes it will be appreciated that, as the projections on the sheets of adjacent electrodes are off-set with respect to each other the cation-exchange membrane cannot be trapped between adjacent projections and the mesh sheets and the membrane will assume a slight sinusoidal shape.

FIG. 3 shows a part of an electrode structure (20) comprising a flexible metallic sheet (21) having a plurality of holes (22) therein which provide passages for flow of liquor from one side of the sheet to the other when the electrode is installed in an electrolytic cell. On one surface of the sheet (21) there are positioned a plurality of bridge-like projections (23) spaced apart from each other in a first direction and in a direction transverse to the first direction. Similarly, on the opposite force of the sheet (21) there are positioned a plurality of bridge-like projections (24) spaced apart from each other in a first direction and in a direction transverse to the first direction. The bridge-like projections (23,24) are formed by forming two parallel slits in the sheet (21) and pressing the part of the sheet between the slits away from the plane of the sheet to one side of the sheet or to the other as required. In this way it will be appreciated that the bridge-like projections (23) on one face of the sheet (21) will be offset in position from the projections (24) on the opposite force of the sheet (21). Although for the sake of clarity they are not shown in FIG. 3 flexible resilient metallic mesh sheets are mounted on and electrically connected to the bridge-like projections (23,24) on the sheet (21). The metallic sheet (21) also has an extension (not shown) for connection to a suitable source of electrical power.

The electrolytic cell shown in part in FIG. 4 comprises a cathode (26) of the type hereinbefore described and a gasket (27) made of a flexible electrically insulating material.

The gasket (27) comprises a central opening (28) and a recess (29) into which the cathode (26) is positioned. Two openings (30,31) are positioned to one side of the central opening (28) and two openings (32, one not shown) are positioned to the opposite side of the central opening (28). The electrolytic cell also comprises an anode (33) and a gasket (34) having a recess (35) into which the anode (33) is positioned. The gasket (34) comprises a central opening (36) and four openings (37,38,39,40) disposed in pairs to either side of the central opening (36). The gasket (41) made of a flexible electrically insulating material comprises a central opening (42), four openings (43,44,45 and 46) disposed in pairs to either side of the central opening, and two channels (47,48) in the walls of the gasket which provide a means of communication between the central opening (42) and the openings (43,46) respectively. The gasket (49) made of a flexible electrically insulating material similarly comprises a central opening (50), four openings (51,52,53 one not shown) disposed in pairs on either side of the central opening, and two channels (54, one not shown) in the walls of the gasket which provide a means of communication between the central opening (50) and the openings (52 and the opening not shown) respectively.

The electrolytic cell also comprises sheets of cation-exchange membrane (55,56) which in the cell are held in position between gaskets (34,49) and gaskets (27,41) respectively.

In the electrolytic cell the gasket (41) and the gasket (34) having anode (33) mounted therein together form an anode compartment of the cell, the compartment being bounded by the cation-exchange membranes (55,56). Similarly, the cathode compartments of the cell are formed by the gasket (27) having cathode (26) mounted therein and by a gasket of the type shown at (49) and positioned adjacent to gasket (27), the cathode compartment also being bounded by two cation-exchange membranes. For the sake of clarity the embodiment of FIG. 4 does not show end plates for the cell which of course form a part of the cell, nor the means, e.g. bolts, which may be provided in order to fasten together the gaskets, electrodes, and membranes in a leak-tight assembly. The cell comprises a plurality of anodes and cathodes as described arranged in an alternating manner.

In the assembled cell the openings (30,37,43,51) in the gaskets (27,34,41,49) respectively form a compartment lengthwise of the cell. Similarly the other openings in the gaskets form together in the assembled cell other compartments lengthwise of the cell, there being four such lengthwise compartments. The cell also comprises means (not shown) by which electrolyte may be charged to the compartment lengthwise of the cell of which the opening (37) in the gasket (34) forms a part and thence via channel (47) in gasket (41) to the anode compartment of the cell. Products of electrolysis may be passed from the anode compartments of the cell via channel (48) in gasket (41) and via the compartment lengthwise of the cell of which opening (39) in gasket (34) to means (not shown) by which the products of electrolysis may be removed from the cell. Similarly, the cell also comprises means (not shown) by which liquid, e.g. water, may be charged to the compartment lengthwise of the cell of which the opening (45) in gasket (41) forms a part and thence via channel (not shown) in gasket (49) into the cathode compartment of the cell. Products of electrolysis may be passed from the cathode compartment of the cell via channel (54) in gasket (49) and via the compartment lengthwise of the cell of which opening (44) in gasket (41) forms a part to means not shown by which the products of electrolysis may be removed from the cell.

In operation the anodes and cathodes are connected to a suitable source of electrical power, electrolyte is charged to the anode compartments and other fluid, e.g. water, to the cathode compartments of the cell, and the products of electrolysis are removed from the anode and cathode compartments of the cell.

I claim:

1. An electrolytic cell comprising terminal electrodes and a plurality of separators, characterised in that the cell comprises at least one electrode structure positioned between the terminal electrodes and comprising projection on both surfaces of an electrially conductive sheet material spaced apart from each other in a first direction and in a direction transverse to the first direction and flexible electrically conductive foraminate sheets electrically conductively bonded to the projections, the sheet having openings therein which permit flow of liquor in a direction transverse to the plane of the sheet material, and a separator positioned between the foraminate sheets of adjacent electrode structures, and between the electrode structures and the terminal electrodes, thereby dividing the cell into separate anode and cathode compartments.

2. An electrolytic cell as claimed in claim 1 characterised in that each terminal electrode comprises a plurality of projections positioned on one surface of a sheet material which projections are spaced apart from each other in a first direction and in a direction transverse to the first direction, and a flexible electrically conductive foraminate sheet electrically conductively bonded to the projections.

3. An electrode structure comprising an electrically conductive sheet material and at least one flexible electrically conductive foraminate sheet spaced apart from the sheet material and electrically conductively bonded thereto, characterised in that a plurality of projections are positioned on at least one surface of the sheet material which projections are spaced apart from each other in a first direction and in a direction transverse to the first direction, and in that the flexible electrically conductive foraminate sheet(s) are electrically conductively bonded to the projections and in that the sheet material has openings therein which permit flow of liquor in a direction transverse to the plane of the sheet material.

4. An electrode structure as claimed in claim 1 characterised in that the sheet material is flexible.

5. An electrode structure as claimed in claim 2 characterised in that the foraminate sheet has a flexibility greater than that of the sheet material.

6. A electrode structure as claimed in claim 1 characterised in that the sheet material comprises projections on both surfaces thereof and in that flexible electrically conductive foraminate sheets are electrically conductively bonded to the projections on both said surfaces.

7. An electrode structure as claimed in any one of claims 2 or 6 characterised in that the height of the projections from the plane of the sheet material is in the range 2 to 15 mm.

8. An electrode structure as claimed in any one of claims 2 or 6 characterised in that the distance between adjacent projections on a surface of the sheet material is in the range 2 to 25 cm.

9. An electrode structure as claimed in any one of claims 1, 2 or 6 characterised in that the structure is metallic.

10. An electrode structure as claimed in any one of claims 1, 2 or 6 characterised in that the foraminate sheet has a thickness in the range 0.1 to 1 mm.

11. An electrode structure as claimed in claim 1 characterised in that the sheet material is resilient and in that the foraminate sheets are resilient.

12. An electrode structure as claimed in claim 1 characterised in that the projections on a surface of the sheet material are spaced apart from each other in a first direction and in a direction substantially at right angles to the first direction.

13. An electrode structure as claimed in any one of claims 1 3 or 6 characterised in that the projections on one surface of the sheet material are staggered in position with respect to those on the opposite surface of the sheet material.

* * * * *